US005713158A

United States Patent [19]

Gibbs

[11] Patent Number: 5,713,158

[45] Date of Patent: Feb. 3, 1998

[54] ROOFING RIDGE INSTALLATION

[76] Inventor: Alden T. Gibbs, 158 Conduit St., Annapolis, Md. 21401

[21] Appl. No.: 567,031

[22] Filed: Dec. 4, 1995

[51] Int. Cl.[6] ..... E04D 13/15; E04D 1/30; E04D 3/40

[52] U.S. Cl. ..... 52/57; 52/198; 52/460; 52/465; 52/745.06

[58] Field of Search ..... 52/43, 47, 54, 52/57, 198, 199, 460, 461, 462, 465, 468, 469, 745.06, 747.1

[56] References Cited

U.S. PATENT DOCUMENTS

| | | | |
|---|---|---|---|
| 1,347,541 | 7/1920 | Hayes | 52/57 |
| 2,071,666 | 2/1937 | Sylvan | 52/199 X |
| 4,558,637 | 12/1985 | Mason | 52/199 X |
| 4,788,801 | 12/1988 | Jones | 52/57 |

FOREIGN PATENT DOCUMENTS

| | | | |
|---|---|---|---|
| 7904041 | 11/1980 | Netherlands | 52/57 |
| 1253835 | 11/1971 | United Kingdom | 52/57 |
| 2167097 | 5/1986 | United Kingdom | 52/57 |

*Primary Examiner*—Carl D. Friedman
*Assistant Examiner*—Kevin D. Wilkens
*Attorney, Agent, or Firm*—Connolly & Hutz

[57] ABSTRACT

A roofing ridge (or hip) installation includes a roof understructure having a pair of outwardly sloping walls which form an inverted V-shaped ridge. A support panel is mounted on each of the walls with the lower end of each support panel optionally terminating in an upwardly facing channel. Tiles such as slates are mounted in each channel. A pressure applying assembly forces the base end of the panels inwardly. A cap spans across and covers the upper ends of the panels and assembly.

27 Claims, 7 Drawing Sheets

36
56
56
58
30
10
60
28
60
32
52
52
24
24
48
26
50
46
44
22
22
16
34
20
14
14
42
18
12

36
56
58
30
60
28
52
24
48
26
22
42
20

Fig. 3.
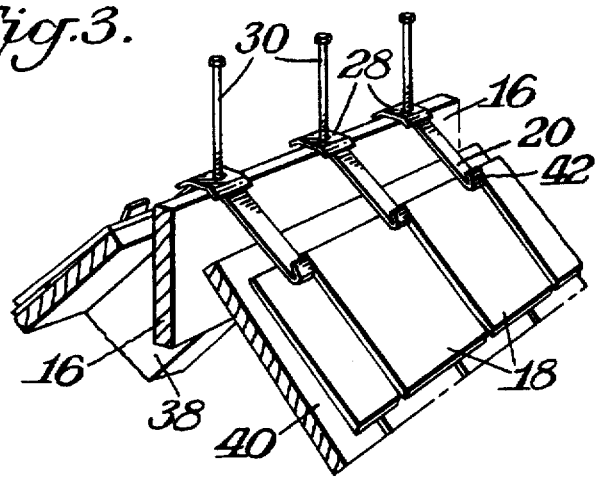
Fig. 4.
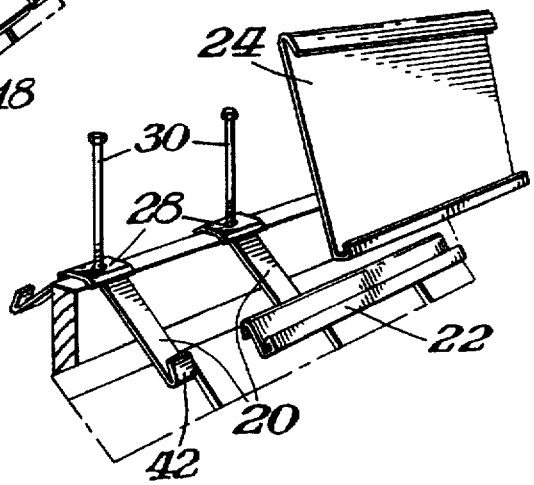
Fig. 6.
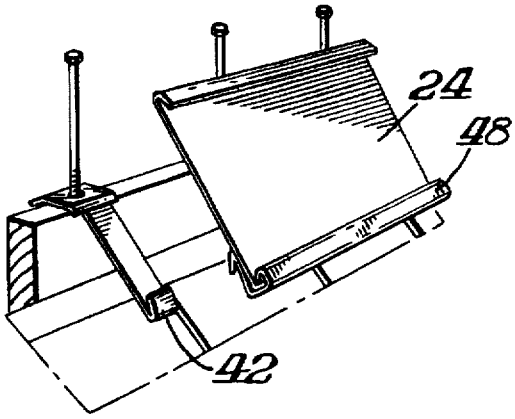
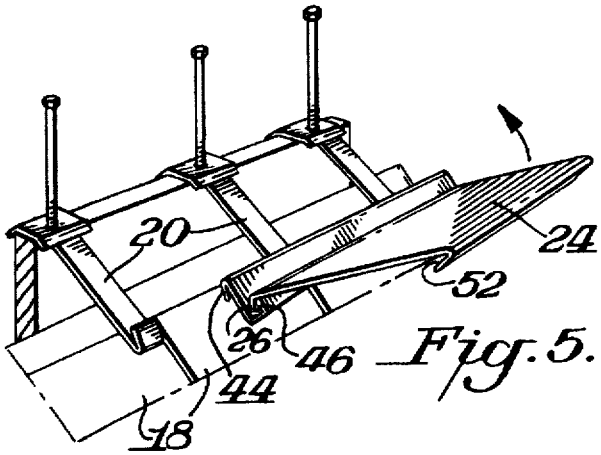
Fig. 5.
Fig. 7.
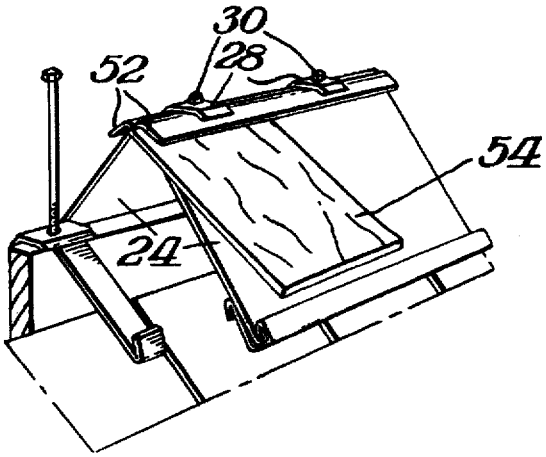

ROOFING RIDGE INSTALLATION

BACKGROUND OF THE INVENTION

In conventional ridge installations tiles such as flat shingles abut at the roof ridge. This causes a juncture or seam which creates a likely area for leaks which is particularly undesirable where a wooden or metal understructure is used. Exposed fasteners also create the potential for leaks. It is customary to utilize various caulking or sealants to fill the juncture voids and to cover the exposed fasteners. Sealants, however, are unsightly and provide only temporary solutions. The best available sealants degrade or crack within a few years. Such materials require repeated maintenance and are incompatible where, for example, tiles are used which have a customary life in excess of 75 years. Similar problems exist for hip installations.

Conventional ridge installations are not only prone to leaks but are also difficult to install, difficult to ventilate and vulnerable to wind damage. Fasteners are placed in corners, the weakest areas of the slate tiles.

SUMMARY OF THE INVENTION

An object of this invention is to provide a roofing installation which overcomes the above disadvantages.

A further object of this invention is to provide such a roofing installation which can be conveniently mounted in an effective manner.

In accordance with this invention the roofing ridge installation includes a roof understructure which could be the framework (rafters) and/or the roof deck wherein the understructure has a pair of outwardly sloping sides to form an inverted V-shaped ridge. A support panel is mounted on each side of the ridge. The lower end of support panel optionally has an upwardly facing channel, while upper ends are disposed toward each other. Tiles are mounted in the channel. A pressure applying assembly is provided to force the base end of the panels inwardly so as to provide a secure mounting. A cap spans over and covers the upper ends of the panels and assembly to prevent leakage at the juncture of the upper ends of the panels.

In preferred practice of this invention anchor straps are mounted the peak of the V-shaped ridge with a base plate secured at each of the anchor straps on each side of the ridge. The panels in turn are mounted to the base plate. The pressure applying assembly is preferably a bracket secured over the upper ends of the panels with a fastener, such as a screw, extending through the bracket and through the strap and then engaged with the understructure. As a result when the fastener is tightened the bracket presses the upper ends of the panels to force the panels downwardly.

THE DRAWINGS

FIGS. 3–8 are perspective views showing the sequence of mounting the components of FIGS. 1–2;

DETAILED DESCRIPTION

The present invention involves improvements in roofing installations which eliminates reliance on adhesives, sealants or caulking and external fastening of the type that is particularly susceptible to leakage and breakage. Instead, the present invention involves an installation which uses an internal type of mounting wherein the components are interrelated in such a manner as to effectively avoid leakage problems without requiring disadvantageous materials such as adhesives or caulking and wherein the components can be mounted in a quick and efficient manner so as to result in effective roofing structure. The present invention permit the mounting of tiles, such as slates in an optimal manner, the slates being imperforate. Alternatively the installation of the invention need not include any roofing tiles at the installation. Since the problems addressed by the invention apply to both ridge and hip installations, the term "ridge" is used in this application to apply to both "ridge" and "hip" installation.

Figures 1, 2:
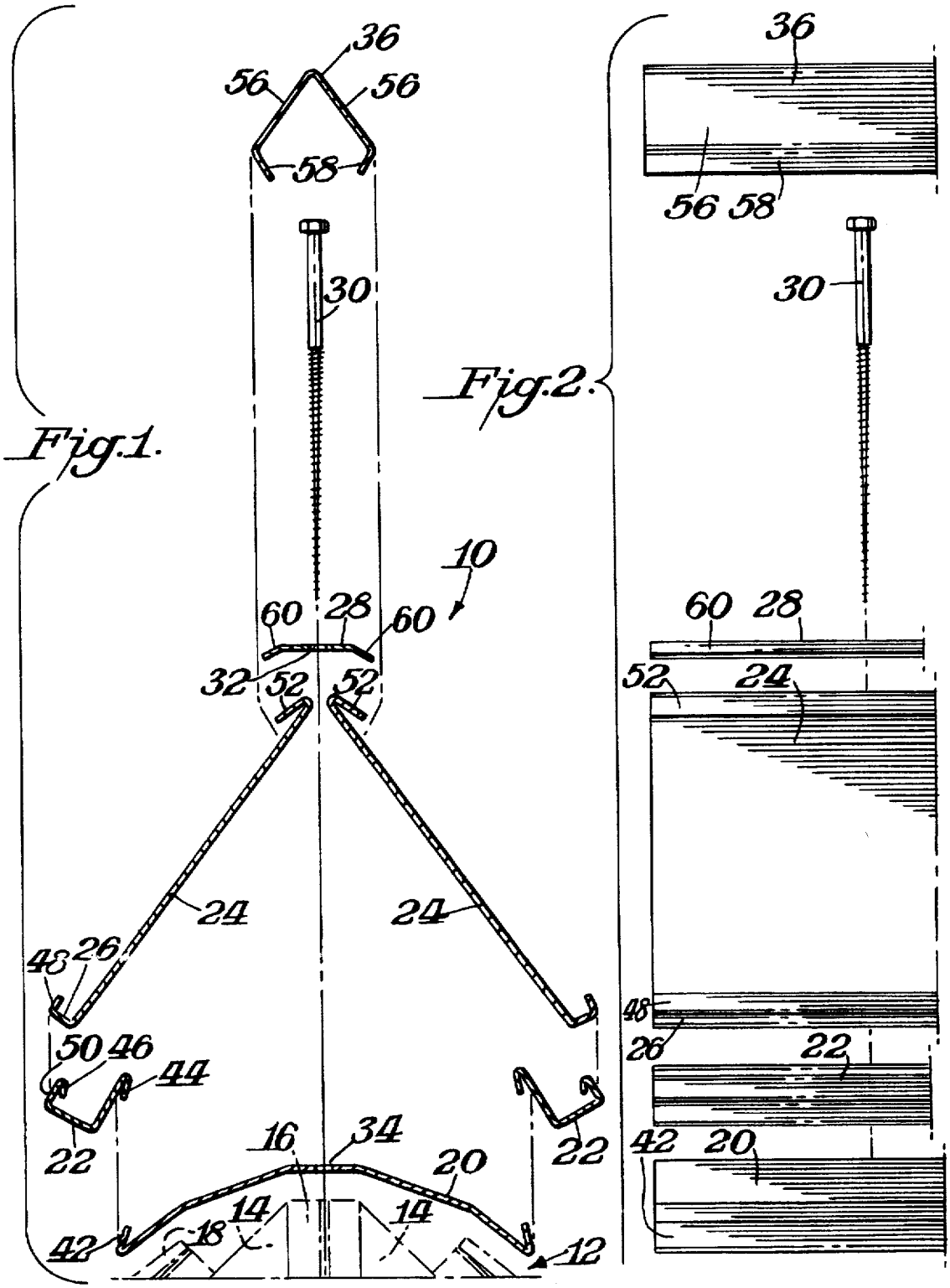
FIG. 1 is an exploded view in end elevation and in section showing components of a roofing ridge installation in accordance with this invention.
FIG. 2 is a side elevational view of the components shown in FIG. 1.

FIGS. 1–2 show a roofing ridge installation 10 in accordance with invention. As shown therein the installation would be utilized on any conventional structure having a roofing understructure 12 which includes a pair of outwardly sloping sides 14 and a ridge pole or truss 16. The sides 14 may be exposed rafters or may a roof deck mounted on the rafters. Conventionally, such understructure is made of wood which would tend to rot or degrade or is made of metal which would tend to corrode when exposed to water such as rain water, as could result where the roof structure self is not sufficiently leak proof.

The installation 10 would also generally be mounted on preceding lower rows of shingle or tile material 18 mounted to the roof deck, rafters tracks or battens in a conventional manner wherein the rows of the tiles overlap each other starting from the lower of the roof which has the first row of tiles and then succeeding rows are mounted thereover in an overlapping fashion as is known in the art. The preferred tile material is "slate" which is intended to include natural and synthetic slate and other flat rigid tile material. The basic components in the installation 10 the disclosed embodiment of FIGS. 1–2 include a plurality of straps or anchor members 20 which extend over the peak of the ridge so as to be disposed on each of the downwardly sloping sides. An elongated base plate 22 is mounted at the lower end of each strap 20. A panel 24 is in turn mounted to each base plate 22 on each of the sides 14. The lower ends of each panel 24 optionally include an upwardly facing channel 26 into which the uppermost rows of tiles would be mounted as later described. For the sake of illustration only a single row or thickness of tiles 18 is illustrated. Conventionally, however, the tiles would overlap to minimize leak and thus be of double thickness.

In the embodiment of FIGS. 1–2 the panels 24,24 on each of the sides 14,14 of the understructure are separate members which are spaced from other to create an elongated opening between the upper ends of the panels. As later described with respect to FIG. 23, howeer, the panels may be connected to each other at their upper ends and openings may be formed at the peak of the integral panels.

Bracket 28 is disposed over the upper ends of the panels 24,24. A fastener 30 extends through a hole 32 in each bracket 28 and then through an aligned hole 34 in strap 20 to permit the fastener 30 to then be anchored or secured to the ridge pole or truss 16. A cap 36 is then snapped over the upper ends of the panels 24,24 to envelope the bracket 28. Alternatively the bracket could be dimensioned to also be contacted by the sides of ridge cap 36.

The fastener and the bracket and their manner of mounting may be considered as a pressure applying assembly which forces the panels 24,24 and inwardly to securely mount the panels and the tiles optionally carried therein to the understructure. The forces involved in this mounting are later described with respect to FIG. 12.

Alternatively, the bracket may be shaped and dimensioned to cooperate with the slate tile itself for having the slate tile function as a panel. In such modified practice of the invention two layers of slate would be utilized wherein the slate tiles are of uniform size with the layers mounted offset from each other by one-half the width of each slate tile to function as a panel.

FIGS. 3–8, in conjunction with FIG. 1, show the sequence in mounting the various components of installation 10. In the sequence of operation illustrated therein the understructure includes rafters 38 and roof deck 40 which may be a plywood or composite board laving roofers felt on its outer surface. The understructure may also be tracks or battens which in turn may optionally be secured to the roof deck. The preceding lower rows of tile 18 are mounted to the roof deck 40. The understructure also optionally includes the ridge board or pole 16.

As shown in FIG. 3 a plurality of preferably equally spaced straps 20 can be pre-mounted to ridge pole or truss 16 by fastener 30 extending through the holes 34 at the center of each strap 20. Brackets 28 would also be mounted over straps 20 with the holes 32 of brackets 28 aligned with holes 34 so that the fasteners 30 could extend through the aligned holes and into the ridge pole or truss 16.

In the illustrated embodiment the roof deck 40 may terminate at the upper edge of ridge pole 16 or there may be a gap between deck 40 and the ridge pole 16 for venting purposes. Before applying the straps and brackets, holes are preferably pre-drilled into ridge pole 16 at the desired locations along the length of ridge pole 16 to accommodate the suitable number of straps which are preferably equally spaced. It is to be understood that the invention could be practiced where the holes are not pre-drilled. Additionally, the ridge pole need not be made of wood but could be made of other suitable materials.

FIG. 4 shows the next sequence of operation. Each strap 20 includes an upwardly turned ear 42 to provide an edge over which the downwardly turned lip 44 of base plate 22 may be hooked. FIG. 4 shows one of the base plates 22 mounted across a plurality of straps 20. A suitable number of base plates 22 would be mounted to the straps 20 along the entire length of ridge pole 16.

After the base plates 22 have been mounted to the straps 20, the panels 24 must next be mounted. FIG. 4 shows the initial step in the mounting of panels 24. Base plate 22 includes a downwardly turned edge 46 at its outer side for receiving the outer wall 48 of panel 24. In order to accomplish this mounting panel 24 is rotated forwardly as shown in FIG. 5 generally perpendicular to the base plate to permit the wall 40 to be disposed within the base plate 22 outwardly of edge 46. Panel 24 is then rotated toward the ridge pole so as to slide the wall 48 between edge 46 and outer wall 50 of base plate 22 as shown in FIG. 6.

The various components may be dimensioned in any suitable size. For example, straps 20 may be located about 18–20 inches apart. Elongated base plates and panels may be utilized such as ten feet long to straddle over a corresponding resultant number of equally spaced straps. Alternatively shorter or longer panels and base plates may be used. It is also to be understood that the base plates and panels may not be of the same length as each other.

FIG. 7 shows the mounting of a slate tile 54 in panel 24. It is necessary to lift the brackets 28 so as to be above the upper ends of panels 24. This could be accomplished by simply spreading the upper ends of panels 24 apart a sufficient distance to pass the brackets 28 between. The fasteners 30 are then tightened a sufficient amount provide a secure mounting where the upper ends of the panels 24 disposed toward each other spaced apart the distance of the fasteners 30. Slate tile 54 is then inserted into panel 24 by the head or upper end of the tile being moved upwardly as far as possible between the down turned edge 52 of panel 24 and the main flat portion of panel 24. As a result there is sufficient clearance of the lower end of slate 54 to pass over wall 48. After slate 54 has passed over wall 48 and is in contact with the main portion of panel 24, slate 54 is permitted to slide downwardly and be held in channel 26 as shown in FIG. 8.

Figure 8:
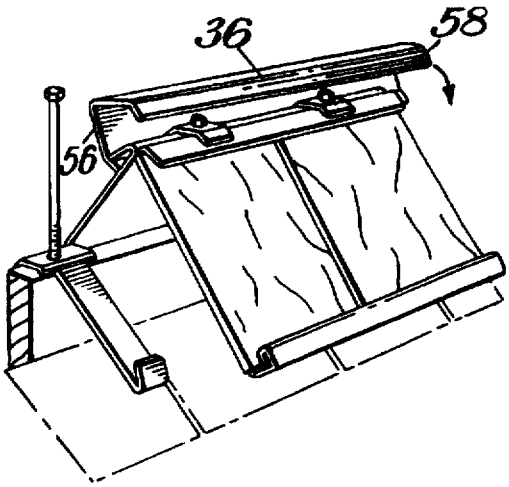

FIG. 8 also shows the mounting of cap 36. Cap 36 includes two elongated connected side portions 56 which terminate in inwardly bent ends 58. Cap 36 is simply snapped into place by, for example, inclining the cap as shown in FIG. 8 so that one of the ends 58 is disposed against the outer edge of end wall 52 of panel 24 and the outer edge of inclined bracket end 60. Cap 36 is then rotated so that the opposite end 58 is disposed over the opposite ends 60 and 52 of the bracket and panel.

Alternatively cap 36 may be mounted by specifically pressing the cap downwardly whereby the end walls 58 of the cap will spread a sufficient distance to snap over the end walls 52 of panel 24. A further alternative would be to simply insert the end cap in a straight horizontal direction by pushing the end cap 36 directly over the ends 52,52 of panels 24,24.

Figure 9:
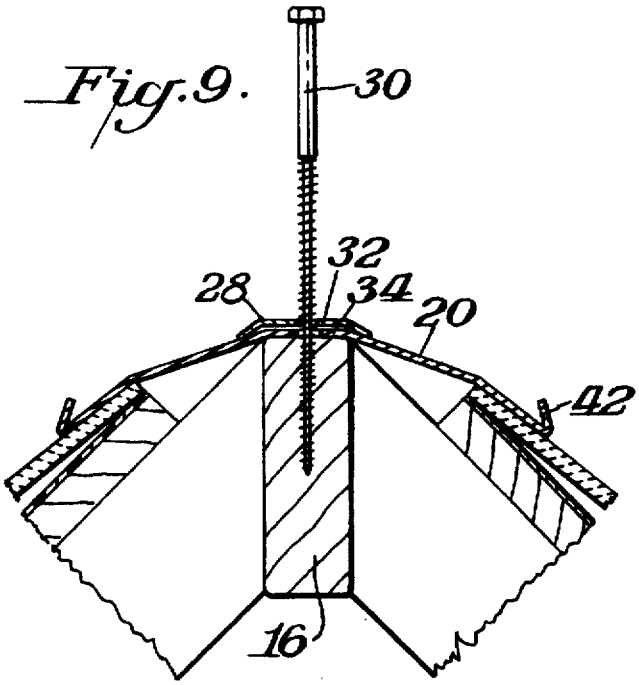
FIG. 9 is an end elevational view in section showing the mounting of some of the components of FIGS. 1–8.
Figure 10:
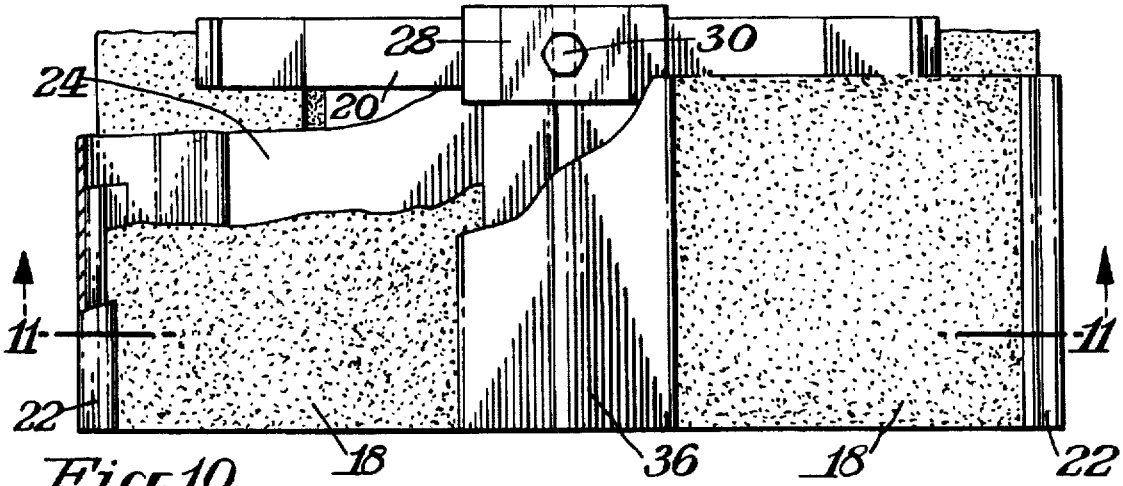
FIG. 10 is a top plan view of the components shown in FIG. 9 in an initial stage of assembly.
Figure 11:
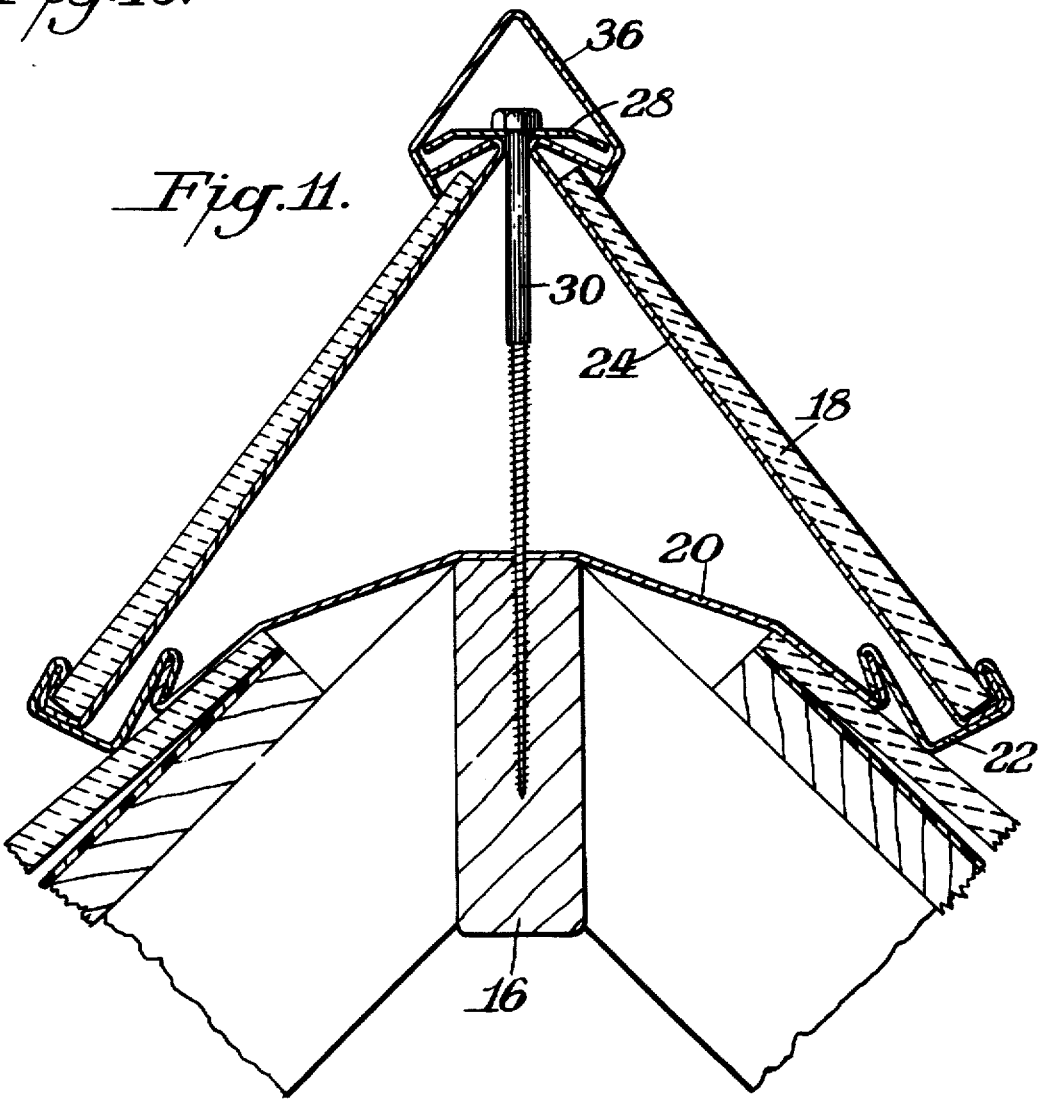
FIG. 11 is a cross-sectional view taken through FIG. 10 along the line 11—11.

FIGS. 9–11 also clearly illustrate the components of installation 10 during the mounting thereof. FIG. 9, for example, shows the fastener 30 extending through holes 32,34 in the bracket and strap and into ridge pole 16. FIG. 11 illustrates the mounting of the components in their final assembled condition.

Figure 12:
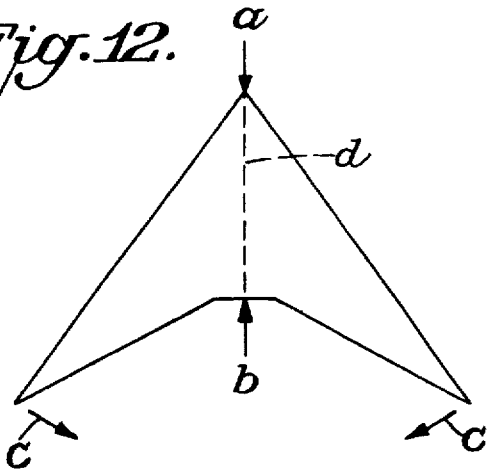
FIG. 12 is a schematic elevational view showing the force vectors in a practice of this invention.

FIG. 12 illustrates the force vectors involved in the mounting of the previously described installation. As shown therein a downward force a equals an opposing force b which moves each base c toward center line d. This results when the points c,c are anchored together. Thus, when the force a is applied downwardly the tendency for the point c,c to spread apart is resisted and overcome by the upward force b because the vector length between the points of contact from force a to point c is greater than the length from the point of contact from force b to point c. The result is for a movement of the structure connecting points c,c along the lower portion of the triangulation illustrated in FIG. 12. This upward force tends to cause points c,c to rotate inwardly. When these force vectors are applied in practical application with the invention the result is an effective mounting by pressing the base ends of the panels toward the understructure. Such practical application would result from the force a being applied by fastener 30 reacting against the upper ends of the panels 24,24 through the aid of bracket 28. The lower corners of the panels are connected together by means of strap 20 and base plates 22,22. The ridge pole or truss 16 provides the upward force b because of the immobile mounting of the ridge pole. Thus, the corners at the lower portion or base of panels 24,24 would be caused to pivot inwardly as fastener 30 is tightened to securely mount the installation against the understructure. This effective mounting is accomplished by the use of internal fasteners.

The concepts of the invention may be practiced with structure other than that specifically shown in FIGS. 1–11. Accordingly, it is not necessary to use a screw or fastener as the means of applying the downward force a. Any other suitable means may be used such as other forms of fasteners. Similarly, it is not necessary to interconnect the base ends of panels 24,24 by structures such as the straps and base plates. Rather, as later described other forms of structure may be used to immobilize or prevent an outward spreading of the base ends of the panels. Various alternative embodiments will be hereinafter described to exemplify alternative structures that may be utilized in the practice of this invention.

Figure 14:
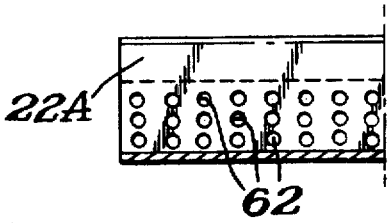
FIG. 14 is a cross-sectional view taken through FIG. 13 along the 14—14.
Figure 13:
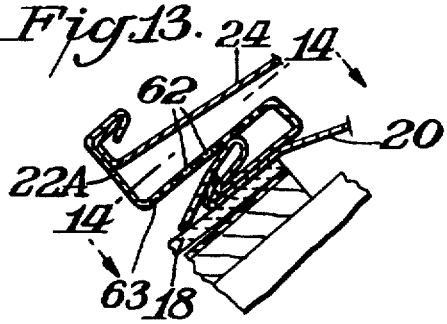
FIG. 13 is a cross-sectional view in elevation of a portion of a modified form of installation in accordance with this invention.

FIGS. 13–14 illustrate a further advantageous variation of the invention wherein the base plate 22A includes ventilating structure such as holes or louvers 62 which could be pressed out ears in the metal base plate. As best shown in FIG. 13 the base plate 22A is of a modified construction as compared to the base plate 22 shown, for example, in FIGS. 1 and 11. As shown in FIG. 13 base plate 22A includes various bends which space the wall 63 away from strap 20 and lower tile 18 to provide an open area for ventilation. The bent end of base plate 22A would also be spaced from wall 63 to assure ventilation.

Figure 15:
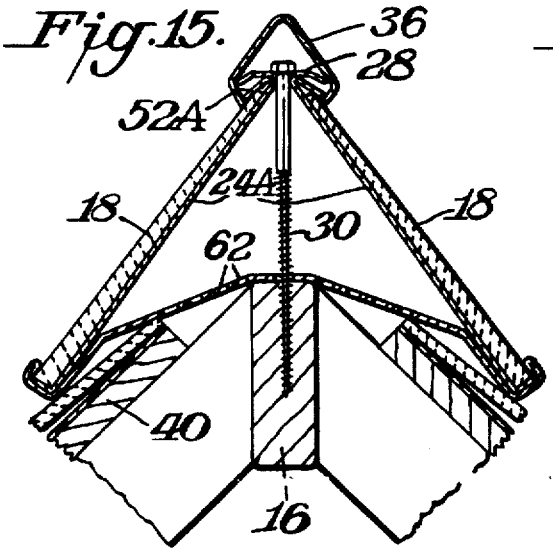
FIG. 15 is a cross-sectional view in elevation of a modified form of installation in accordance with this invention.
Figure 23:
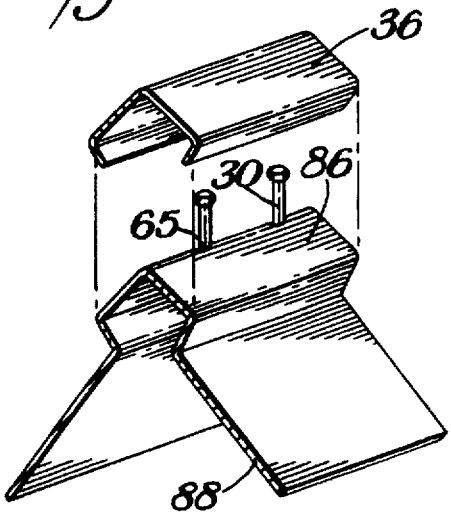
FIG. 23 is a view similar to FIG. 21 of yet another form of installation on in accordance with this invention.
Figure 21:
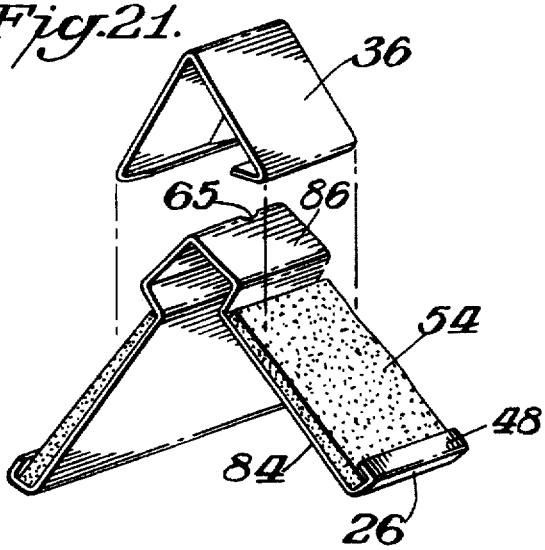
FIG. 21 is a perspective view of yet another modified form of installation in accordance with this invention.
Figure 22:
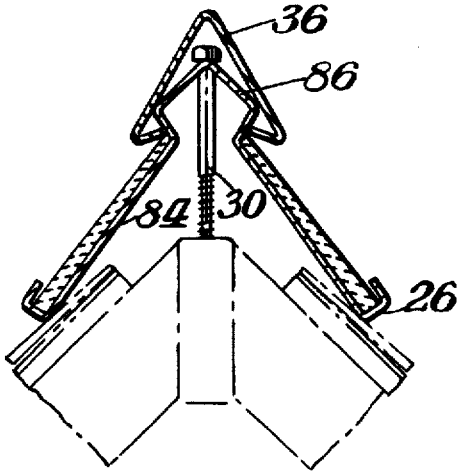
FIG. 22 is an end elevational view partly in section of a form of install shown in FIG. 21.

FIG. 15 illustrates a variation of the invention wherein the panels 24A are integral with each other at their lower ends so as to comprise a one piece retainer panel which eliminates the need for separate straps and base plates. Ventilation holes 62 are also provided at the gaps between ridge pole 16 and deck 40. Where the upper ends are not connected, outwardly bent flanges 52A would be provided. If desired the upper ends of panels 24A, 24A could be integral as illustrated in FIGS. 21–23. In each of the embodiments where the panels are of one piece construction at their upper ends, corresponding holes 65 would have to be formed at the peak to permit the passage of fasteners 30 therethrough as shown in FIGS. 21–23.

Figure 17:
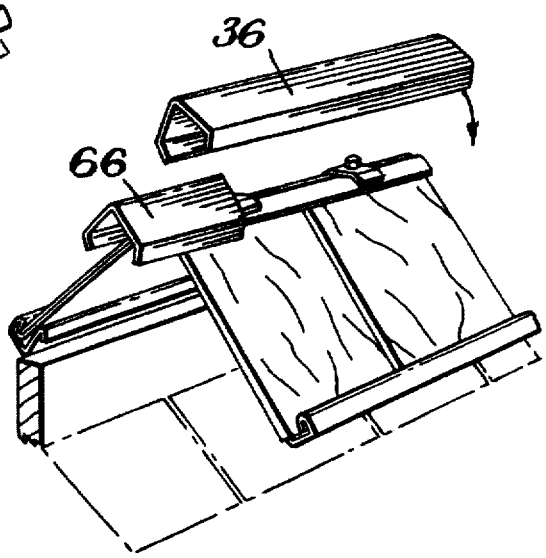
FIGS. 16–18 are perspective views showing the use of spliced components which may be used in the roofing ridge installation of this invention.
Figure 16:
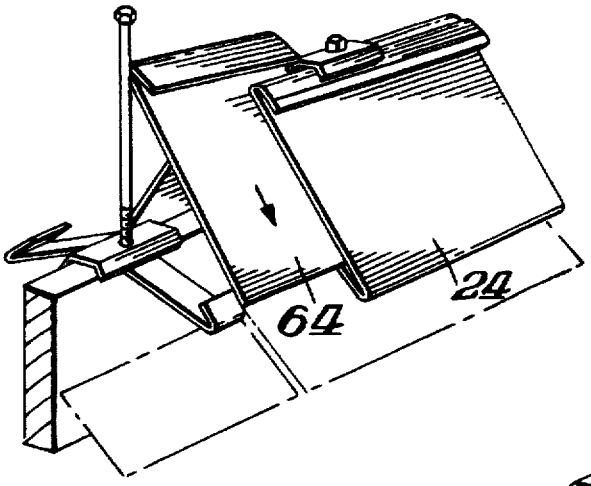
Figure 18:
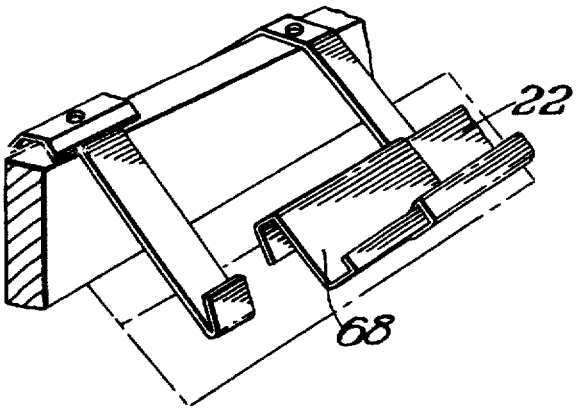

FIGS. 16–18 show further variations of the invention which involve spliced components located at the juncture of their corresponding components. FIG. 16, for example, shows a spliced panel section 64 which would be mounted in a base plate 22 at the edge of a panel 24 where the panel would be juxtaposed to its adjacent panel. The provision of the splice panel 64 provides further assurance that there will be minimal chances of leakage.

FIG. 17 shows an internal splice cap 66 which would be located below adjacent caps 36.

FIG. 18 shows a splice base plate 68 which would be located within and across the junction of adjacent base plates 22.

The concept of providing spliced components may be utilized to span each set of similar components which are disposed against each other. The provision of such spliced components thus prevents leakage between the adjacent corresponding components.

Figure 19:
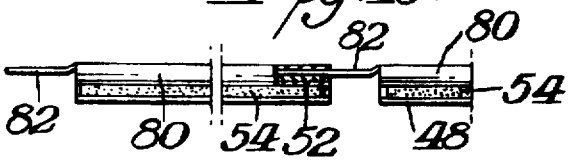
FIG. 19 is a plan view, partly in section, of a modified form of spliced components in accordance with this invention.
Figure 20:
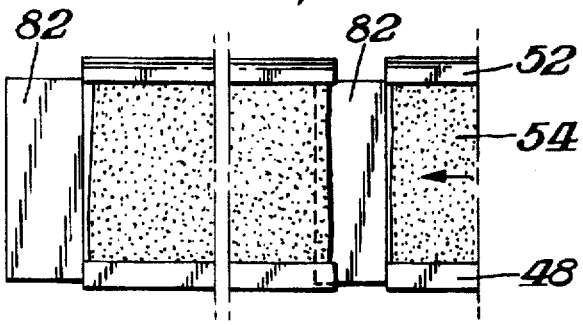
FIG. 20 is a side elevational view of the spliced components shown in FIG. 19.

The concept of providing spliced components need not be practiced in the manner shown in FIGS. 16–18. FIGS. 19–20, for example, show a variation of the splicing concept wherein the primary components are modified for slicing or overlapping engagement with each other without requiring a separate splice component. As shown in FIGS. 19–20 each panel 80 has an integral sidewardly extending tongue 82 which would be inserted between the bent ends 48,52 to provide an overlap at the juncture of two adjacent panels. FIGS. 19–20 show a step during the sliding insertion of tongue 82 from the right hand panel into sliding contact with its adjacent left hand panel 80. The sliding movement would continue until the tongue 82 is completely inserted.

FIGS. 21–22 show a modification of the invention wherein a one piece panel 84 is provided which is integral at its upper end by means of central connecting section 86. A hole 65 is formed in the upper connecting end 86 to permit the passage of fastener 30. The lower ends of panel 84 could be integrally joined as shown in FIG. 15 or could be separate from each other and interconnected by straps and base plates or could be otherwise mounted on each side of the understructure.

In the embodiment shown in FIGS. 21–22 a channel 26 is provided into which the feet of the tiles 54 would be mounted before the tiles are placed at the upper end of panel 84 on each side thereof so that the tiles can rotate in place and the head of each tile is retained by the clamp fit of cap 36.

FIG. 23 illustrates a modification of the installation shown in FIGS. 21–22 which is a tileless or slateless installation wherein the panels 88 themselves are exposed and function as the exterior of the installation. FIG. 16 also illustrates an installation wherein no tiles or slate is mounted to the panels. It is to be understood that the various embodiments shown herein having channel members, such as channel 26 at the base portion of each panel may be modified to omit the channel where it is not necessary or desired to have tiles mounted at the ridge installation.

Where the upper ends of the panels such as panels 84,88 are integral it is not necessary to provide a bracket (such as bracket 28) since the fastener 30 would press directly against the bent upper end 86 of the one-piece panel.

Figure 24:
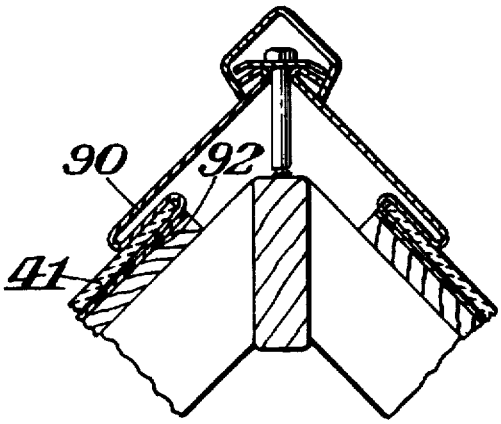
FIGS. 24–25 are cross-sectional views in elevation of yet further modified forms of installation in accordance with this invention.
Figure 25:
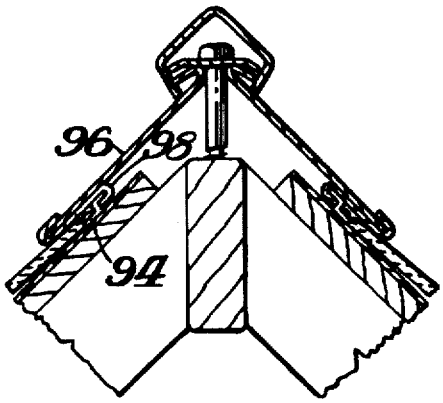

FIGS. 24–25 illustrate variations of the invention wherein the lower ends of the panels are anchored without the use of straps or base plates. As shown in FIG. 24 the lower end of panel 90 includes a bent portion 92 which extends below the preceding lower row of tiles 44 along the upper edge of the roof deck. If desired the bent end could terminate at the upper edge of the tiles 41 and extend directly toward the understructure without having the final bend 92.

FIG. 25 illustrates a variation wherein tracks 94, such as Z-shaped tracks are mounted to the understructure and the lower end of panel 96 is mounted in place by S-type hooks 98 which hook over the Z-shaped track and around the lower end of the panels 96 as illustrated.

The installation of this invention utilizes a snap cap to avoid the necessity for external fasteners which otherwise provides a prime area of leakage. Such snap caps additionally function as a means of sealing the portion of the installation most prone to leakage, while at the same time providing an advantageous decorative effect. The snap cap further functions to press against the tile and thus prevent chatter which might otherwise occur under high wind conditions.

The upper end of each panel 24 which includes the bent end 52 has a number of advantageous functions. For example, the upper end of the panel holds the head of the slate or tile to ensure proper mounting of the tile. Additionally, the bent end provides a baffle which minimizes the possibility of water leakage such as from rain. The bent end also functions to engage the snap cap and acts as a bearing surface for the bracket 28.

The foot or channel 26 of panel 24 also has a number of functions. The channel 26 and wall 48 hold the lower end of the slate or tile. In addition, the foot provides structure for facilitating the mounting of the panel in place during its rotational movement into base plate 22.

The invention may be practiced with a number of variations within the concepts of the invention. For example, instead of using metal materials such as for the straps 20 or other components which could be stamped in shape, the components could be brake pressed or could be molded or extruded from metal or plastic materials. The components could also be roll formed or wire formed. Any suitable fastener could be used which applies a force to the feet of the panels mounted in the base plates.

The illustration and description of a screw 30 is merely for exemplary purposes. Instead of having a strap 20 which spans over the peak of the understructure, individual anchor members may be provided separate from each other on each side of the understructure which would include the necessary structure for anchoring the overlaying components. Tracks could be used which are, for example, of Z-shape (FIG. 25) or J-shape or U-shape wherein the tracks are of continuous length or could be discontinuous and need not be narrow in dimension such as straps 20 are illustrated to be.

The fastener could bear on an internal portion of the panel close to the ridge pole or truss rather than being secured to the ridge pole or truss.

Figure 26:
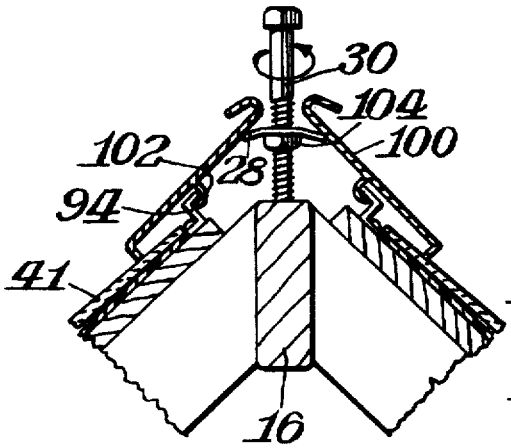
FIGS. 26–27 are cross-sectional views in elevation of still yet other modified forms of this invention.

FIG. 26 illustrates yet another modified form of the invention wherein vector forces are applied in a different manner than schematically illustrated in FIG. 12. As shown in FIG. 26 a modified panel 100 is utilized having a flange 102 or other anchor member at a location between its base end and its upper end. The flange 102 is secured to an anchor member on the understructure such as track 94. In the illustrated embodiment track 94 has an upwardly extending leg over which the flange 102 is hooked. Other manners of mounting, however, may be utilized such as an upwardly extending flange being inserted under a downwardly extending wall or leg of a track.

In the embodiment of FIG. 26 the bracket 28 remains within the pair of panels 100 below their upper ends rather than being disposed above the panels as in the prior embodiments. Bracket 28 is locked in place on fastener 30 by a suitable nut 104 or other anchor member. As a result, when fastener 30 is manipulated to raise the bracket, the ends of the bracket 28 react against the upper ends of panels 100 forcing the panels to pivot about the location of mounting of flange 102 and track 94 thus, in turn, forcing the base ends of panel 100 to rotate inwardly. Accordingly, the practice of the invention shown in FIG. 26 is common to the prior practices wherein there is an anchoring or holding of the panels and an application of force which causes the base ends of the panels to rotate inwardly and press toward the understructure. This effective mounting is accomplished with the use of internal fasteners since an end cap would also be snapped over the fastener 30 in the embodiment of FIG. 26 although the end cap is not illustrated.

Figure 27:
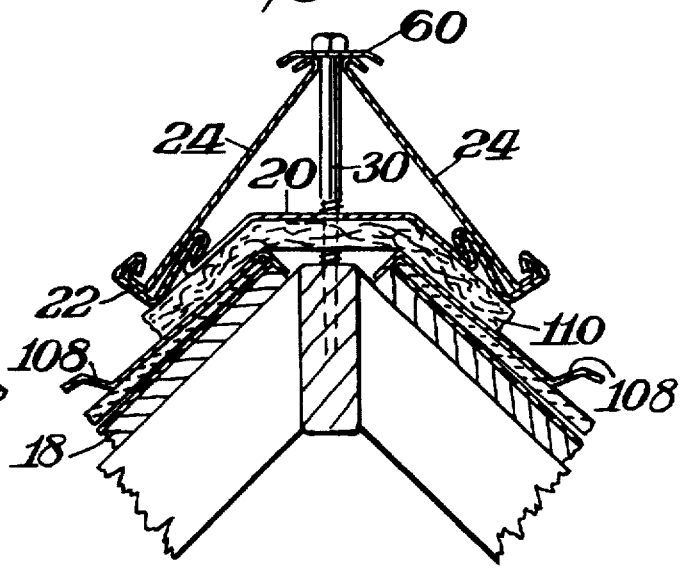

FIG. 27 shows a further variation of the invention wherein an external baffle 108 is mounted at the top end of the upper course or row of tiles 18. Baffle 108 could be detached or an integrated external baffle. A continuous length of filter mesh material 110 is mounted over baffle 108 and the strap 20 is mounted over the mesh material 110. The remaining components would then be mounted in the previously described manner. This embodiment thus involves the optional use of a detached or integrated venting intermediary system which could be well secured by the clamping action previously described.

It is to be understood that the invention may be practiced with numerous variations. For example, a separate structure, such as an anchor which could be a continuous or discontinuous track could be affixed to the understructure of the roof. The base of the panel could be prevented from descending downwardly along the understructure by engagement with separate structure (e.g. the track). Such an arrangement would use compressive forces.

Discontinuous panels could be used which would be water shedding or could be structural only, for example, by an interior, load bearing frame covered by an appropriate watertight skin over the panels and associated structure.

The panels themselves could be formed and/or perforated to allow ventilation from an interior space below the panels. For example, plastic corrugated board is already employed in various roofing installations to provide ventilation.

The invention could be utilized on a hip section or a roof and where two adjacent roof sections intersect at an angle. Thus the term ridge is intended to be used not only in the conventional sense, but also to include sections which intersect at an angle to form a peak, horizontally or inclined.

In the illustrated and preferred practice of this invention the tiles or roofing material is rigid material preferably slate. The invention, however, could be used with other types of roofing material such as flexible shingles or simply as a finish to metal roofs.

It is to be understood that features shown in the various embodiments may be used in other embodiments in accordance with this invention.

The advantages of the present invention include the elimination of any reliance on sealants or external fasteners and the elimination of weakened slates. Rather internal fasteners are used to clamp the roofing materials and other components of the installation in place in an effective manner wherein any roof pitch could be accommodated.

What is claimed is:

1. A roofing ridge installation comprising a roof understructure having a pair of outwardly sloping sides which form an inverted V-shaped ridge having a peak, a plurality of panels mounted on each of said sides, each of said panels having a lower end, said lower ends being disposed remote from each other, anchor members interconnecting said lower ends, said panels having upper ends disposed near each other, a pressure applying assembly mounted against said upper ends of said panels to apply a force against said upper ends of said panels, and said pressure applying assembly applying an upward force against said anchor members at a location between said upper ends and said lower ends to resist said force against said upper ends and thereby create an inward force against said lower ends of said panels for moving said lower ends toward said understructure.

2. The installation of claim 1 wherein said pressure applying assembly includes a bracket mounted over said upper ends of said panels, and a fastener mounted through said bracket and into said understructure.

3. The installation of claim 1 wherein each of said panels includes a downwardly turned upper edge.

4. The installation of claim 1 including splice structure at the juncture of two of said panels overlapping said juncture of said panels.

5. The installation of claim 4 wherein said splice structure for said panels comprises a tongue mounted to one of said two panels, and said tongue being inserted into said other of two panels to overlap said juncture.

6. The installation of claim 1 including a cap spanning across and covering said upper ends of said panels.

7. The installation of claim 6 wherein said pressure applying assembly includes a fastener mounted between said upper ends of said panels, said anchor members being sets of straps, each of said straps extending over said peak and being disposed on both of said sides of said understructure, a bracket disposed over said upper ends of said panels and aligned with a respective one of said straps, and said fastener extending through a respective one of said bracket and said strap and mounted to said understructure directly above said peak to press said bracket against said panels.

8. The installation of claim 7 wherein said cap is a snap cap having an outer wall which is disposed over and envelopes said bracket and said upper edge of said panels.

9. A roofing ridge installation comprising a roof understructure having a pair of outwardly sloping sides which form an inverted V-shaped ridge having a peak, a plurality of panels mounted on each of said sides, each of said panels having a lower end, said lower ends being disposed remote from each other, said panels having upper ends disposed near each other, a pressure applying assembly mounted against said upper ends of said panels to apply a force against said upper ends of said panels and an inward force against said lower ends of said panels for moving said lower ends toward said understructure, a plurality of caps spanning across and covering said upper ends of said panels, anchor members on each of said sides, said anchor members being straps, base plates mounted to at least one of said straps on each of said sides, and said panels being mounted to said base plates.

10. The installation of claim 9 including splice structures at the juncture of two of said panels to overlap said juncture of said panels, splice structure at the juncture of two of said base plates to overlap said juncture of said base plates, and splice structure at the juncture of two of said caps to overlap said juncture of said caps.

11. The installation of claim 10 wherein said splice structure for said panels comprises a separate panel section which is inserted into and overlaps said juncture of said two panels.

12. The installation of claim 10 wherein said splice structure for said panels comprises a tongue mounted to one of said two panels, and said tongue being inserted into said other of two panels to overlap said juncture.

13. The installation of claim 9 wherein each of said straps terminates in a lower end having an upwardly turned ear, and said base plate being hooked to said ear.

14. The installation of claim 13 wherein each of said lower ends of said panels terminates in an upwardly facing channel, at least one roofing tile mounted in each channel, and said base plate also being hooked onto said channel of said panel.

15. The installation of claim 14 wherein said pressure applying assembly includes a fastener mounted between said upper ends of said panels, said straps being sets of straps, each of said straps extending over said peak and being disposed on both of said sides of said understructure, a bracket disposed over said upper ends of said panels and aligned with a respective one of said straps, and said fastener extending through a respective one of said bracket and said strap and mounted to said understructure directly above said peak to press said bracket against said panels.

16. The installation of claim 15 wherein said upper ends of said panels includes a downwardly turned edge, and said tile being captured against said panel with said tile having a head end at said downwardly turned edge and a lower end in said channel.

17. The installation of claim 16 wherein said cap is a snap cap having an outer wall which is disposed over and envelopes said bracket and said downwardly turned edge of said panel.

18. The installation of claim 17 wherein one of said fastener and said bracket is provided for each of said straps, and said base plate spans a plurality of said straps.

19. The installation of claim 18 including a plurality of said base plates and a plurality of said panels, and each of said panels supporting a plurality of tiles.

20. The installation of claim 19 wherein said tiles are made of slate.

21. A roofing ridge installation comprising a roof understructure having a pair of outwardly sloping sides which form an inverted V-shaped ridge having a peak, a panel mounted on each of said sides, each of said panels having a lower end, said lower ends being disposed remote from each other, said panels having upper ends disposed near each other, a pressure applying assembly mounted against said upper ends of said panels to apply a force against said upper ends of said panels and an inward force against said lower ends of said panels for moving said lower ends toward said understructure, a cap spanning across and covering said upper ends of said panels, said pressure applying assembly including said understructure applying an upward resistance force in line with said force against said upper ends of said panels, and said upward resistance force being applied at a location between said lower end and said upper end of each of said panels.

22. A method of mounting a roof installation comprising mounting a panel on each side of a pair of outwardly sloping sides of a roof understructure wherein the outwardly sloping sides form an inverted V-shaped ridge having a peak, and with the panels having upper ends disposed near each other and lower ends disposed remote from each other, applying a downward force against the upper ends of the panels by a pressure applying assembly, and applying an inward force against the lower ends of the panels by anchor members interconnecting the lower ends of the panels, and applying an upward force against the lower ends of said panels by the anchor members at a location in line with the downward force and between the upper and lower ends of the panels to rotate the lower ends of the panels toward each other and toward the understructure.

23. The method of claim 22 including applying the downward force by a fastener which is part of the pressure applying assembly and which acts against the upper ends of the panels, applying the upward force by the resistance of the understructure against the anchor members located directly below the application of the downward force, and mounting a cap over the fastener and upper ends of the panels after the forces have been applied.

24. The method of claim 22 wherein an upper force is applied against the upper ends of the panels to spread the upper ends away from each other.

25. A method of mounting a roof ridge installation comprising mounting a plurality of spaced mounting straps over the peak of a roof understructure with each mounting strap having an upturned ear, mounting a plurality of base plates to the mounting straps by hooking each base plate over a plurality of the mounting straps at the upturned ears on each side of the understructure, mounting a plurality of panels to the plurality of base plates on each side of the understructure, applying a downward force to the upper ends of the panels by a pressure applying assembly, applying an upward force to the lower ends of the panels by the mounting straps at a location between the upper ends and lower ends with the distance between the lower ends and the location of application of the upward force being smaller than the distance between the lower ends and the location of the application of the downward force to force the panels downwardly and inwardly, and applying a cap over the upper ends of the panels.

26. The methods of claim 25 wherein each panel includes a channel at its lower end, each panel being mounted to its base plate by disposing the panel generally perpendicular to the base plate to insert the channel of each panel into and under a downturned edge of the base plate, and then rotating the panel toward the peak.

27. The method of claim 26 mounting a plurality of roofing tiles to the plurality of panels including each tile being a slate tile which is mounted to its panel by first inserting the head of the slate tile below a downturned end portion of the panel until the lower edge of the slate tile has cleared the outer wall of the channel of the panel, and then sliding the slate tile against the panel until the lower end of the slate tile is seated in the channel.

* * * * *